US006273450B1

(12) United States Patent
Challande et al.

(10) Patent No.: US 6,273,450 B1
(45) Date of Patent: Aug. 14, 2001

(54) RETENTION DEVICE FOR A BOOT ON A GLIDE BOARD WITH A DORSAL SUPPORT ELEMENT

(75) Inventors: Christian Challande, Cruseilles; Cedric Ragot, Paris, both of (FR)

(73) Assignee: Salomon, S.A., Metz-Tessy (FR)

( * ) Notice: Subject to any disclaimer, the term of this patent is extended or adjusted under 35 U.S.C. 154(b) by 0 days.

(21) Appl. No.: 09/024,060

(22) Filed: Feb. 17, 1998

(30) Foreign Application Priority Data

Feb. 18, 1997 (FR) ..... 97 02138

(51) Int. Cl.[7] ..... A63C 9/00

(52) U.S. Cl. ..... 280/624; 280/633; 280/11.36; 280/14.22

(58) Field of Search ..... 280/617, 618, 280/620, 623, 624, 625, 626, 631, 633, 634, 14.21, 11.36, 14.22; 36/117.8, 117.9, 118.2, 118.3, 118.4, 118.9, 119.1

(56) References Cited

U.S. PATENT DOCUMENTS

| | | | | |
|---|---|---|---|---|
| 3,303,584 | * | 2/1967 | Werner et al. | 36/118.2 |
| 4,199,879 | * | 4/1980 | Wegeng | 36/118.2 |
| 5,175,948 | * | 1/1993 | Tonel et al. | 36/118.3 |
| 5,609,347 | * | 3/1997 | Dressel | 280/14.2 |
| 5,713,587 | * | 2/1998 | Morrow et al. | 280/623 |
| 5,832,635 | * | 11/1998 | Finney et al. | 36/118.2 |
| 5,901,469 | * | 5/1999 | Saillet | 36/118.2 |
| 5,926,979 | * | 7/1999 | Borel | 36/118.3 |
| 5,947,487 | * | 9/1999 | Keleny et al. | 36/118.2 |
| 5,967,531 | * | 10/1999 | Saillet | 36/118.2 |

FOREIGN PATENT DOCUMENTS

| | | | | |
|---|---|---|---|---|
| 2146187 | | 10/1995 | (CA) . | |
| 3622746 | | 1/1988 | (DE) . | |
| 2719197 | | 11/1995 | (FR) . | |
| 2746604 | | 10/1997 | (FR) . | |
| 406121862A | * | 5/1994 | (JP) | 280/14.2 |
| 406178701A | * | 6/1994 | (JP) | 36/118.2 |

* cited by examiner

*Primary Examiner*—Frank Vanaman
(74) *Attorney, Agent, or Firm*—Greenblum & Bernstein, P.L.C.

(57) ABSTRACT

A retention device for a boot on a glide board adapted to be used for snowboarding. The device includes a base adapted to receive the sole of the boot, and a dorsal support element on which the upper of the boot is adapted to take support, a raised portion of the heel support extending the base upwardly towards the rear of device, the dorsal support element including a top part, a bottom part connected to the base, the top and bottom parts being relatively stiff. An intermediate deformable part of the dorsal support element is located between the top and bottom parts, the intermediate part allowing an inclination of the top part with respect to the bottom part along at least one transverse direction of the device.

38 Claims, 4 Drawing Sheets

RETENTION DEVICE FOR A BOOT ON A GLIDE BOARD WITH A DORSAL SUPPORT ELEMENT

BACKGROUND OF THE INVENTION

1. Field of the Invention

The present invention is related to a retention device for a boot on a glide board. More specifically, it is related to the field of snowboarding.

2. Description of Background and Relevant Information

In snowboarding, the user's feet are affixed to a board in a position that is substantially transverse with respect to the longitudinal direction of the board. The boots as well as the devices for retaining boots on the glide board must be able to provide adequate comfort to the user, and allow him to steer the board correctly under all circumstances. In order to fulfill these requirements, it is desirable for the boot to be relatively flexible so that the user can walk easily, and so that he/she can bend his/her legs towards the front or to the sides while steering the board, or while executing jumps or figures.

It is also desirable that each retention device allows the user to take rearward support with the lower part of the leg, especially during turns or when the user's back faces a slope.

Prior art documents have suggested retention devices for a flexible boot that allows the user to bend his/her leg towards the front or to the sides, while at the same time providing adequate rearward support.

In particular, the French Patent Publication No. 2746604 discloses a device comprising a base that is extended towards the rear by a portion of the heel support, a dorsal support element being journalled on the heel support portion along an axis contained in the median vertical plane of the base. This device comprises an elastic return means that elastically resists the inclination of the dorsal support element along one of the lateral sides of the device by rotation about the axis when a boot that is retained on the base is tipped.

The device disclosed in French Patent Publication No. 2746604 is very satisfactory in the help that it provides to the user while snowboarding, and is especially satisfactory in terms of safety.

However, this device does not allow the dorsal support element to perfectly follow the movements of the lower part of the user's leg, especially in the direction of a lateral inclination, because the structure of the ankle journal induces complex movements of the bone which are different from a simple rotation about an axis.

As a result, the dorsal support element rubs against the boot or the lower part of the user's leg, thereby hindering the steering.

In addition, this device is relatively complex and expensive to manufacture.

SUMMARY OF THE INVENTION

It is an object of the invention to overcome the disadvantages of the aforementioned device.

To this end, the present invention proposes a retention device for a boot on a glide board intended to be used for snowboarding, the device comprising a base intended to receive the sole of the boot, and a dorsal support element on which the upper of the boot is intended to rest, a raised portion of the heel support extending the base upwardly towards the rear of the device, the dorsal support element including a top part and a bottom part connected to the base, the top and bottom parts being relatively stiff.

According to the invention, an intermediate deformable part of the dorsal support element is located between the top and bottom parts, the intermediate part allowing for an inclination of the top part with respect to the bottom part along at least one transverse direction of the device.

The intermediate deformable part allows the dorsal support element to faithfully follow the movements of the lower part of the leg with respect to the foot, not being constrained to move about a single pivot axis. Therefore, the dorsal support element does not rub against the boot or the lower part of the leg. The advantageous result thereof is that the steering of the board becomes easier.

Further according to the invention, the intermediate deformable part includes at least one rib that is used to stiffen the dorsal support element along the longitudinal direction of the foot. The user can thus take rearward support in order to execute edge settings.

Preferably according to the invention, the intermediate deformable part includes five ribs demarcating spaces. This structure improves the ability of the dorsal support element to follow the lateral inclination movements of the user's legs.

Also preferably according to the invention, the ratio of the width of a rib as compared to the thickness of the same rib is greater or equal to five. This structure provides a good compromise between the rearward stiffness and the lateral flexibility of the dorsal support element.

Still further according to the invention, two juxtaposed ribs have opposing faces, forming an angle between zero and eight degrees.

The angle of the faces makes it easier to remove snow when the dorsal support element is deformed laterally.

Preferably according to the invention, the dorsal support element is made all in one piece, or unitary, thus making its structure simple.

Also, the dorsal support element is preferably made of a plastic material, which allows the manufacturing costs to be reduced.

According to a variation, at least one space of the intermediate deformable part of the dorsal support element is at least partially filled by a material that is different from the component material of the dorsal support element. This allows for a symmetrical or asymmetrical adjustment of the lateral deformation capacity of the dorsal support element.

On the other hand, the dorsal support element is journalled on the base along a substantially transverse axis of the device. As a result, the user can fold his/her equipment for storage.

Finally, according to the invention, the raised portion of the heel support limits any displacement of the dorsal support element along the axis in a front to rear direction. Consequently, the user can bend his/her legs towards the front and take stiff rearward supports.

BRIEF DESCRIPTION OF THE DRAWINGS

Other characteristics and advantages of the invention will be better understood with the help of the following description, and with reference to the annexed drawings that illustrate, via non-restrictive embodiments, how the invention can be made and wherein.

DETAILED DESCRIPTION OF THE INVENTION

Figure 1:
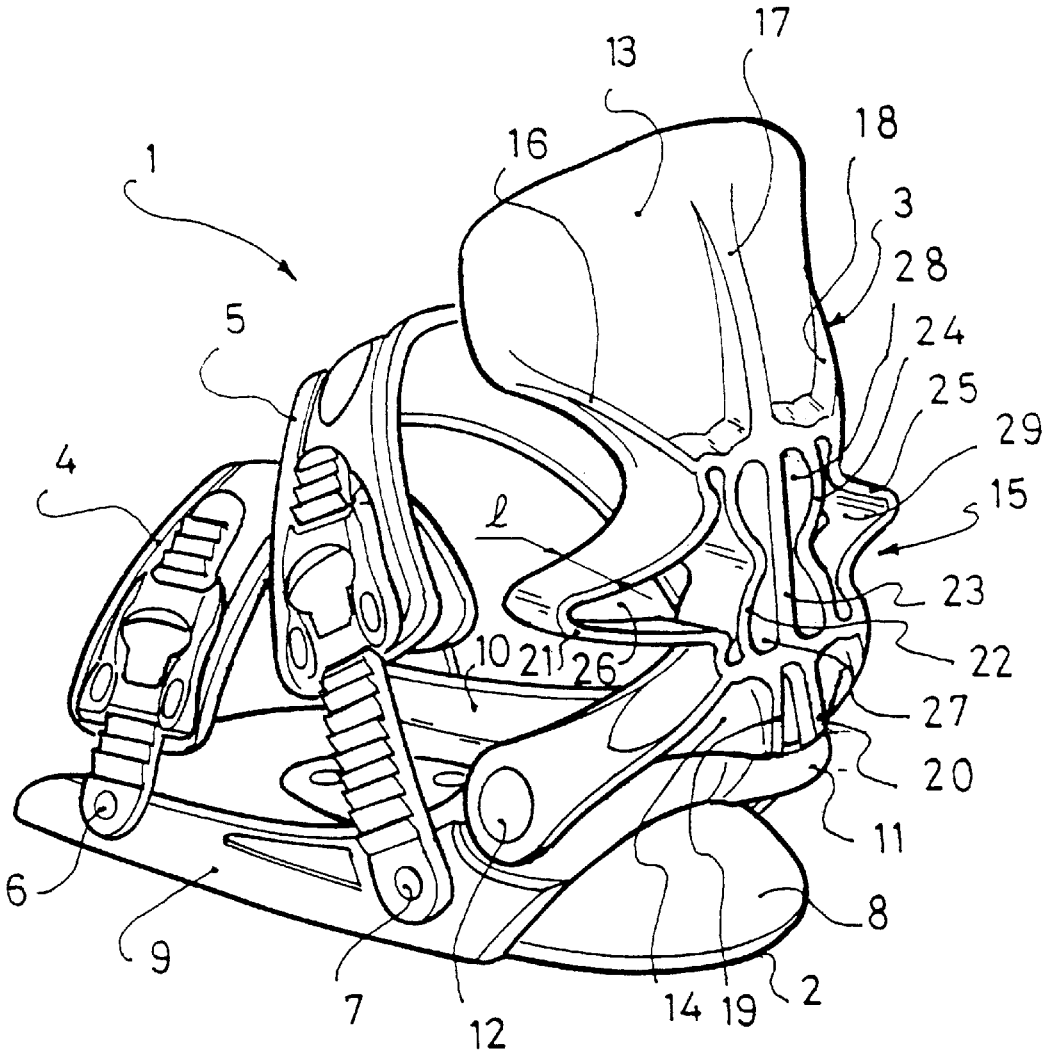
FIG. 1 is a rear perspective view of a retention device as per the invention according to a first embodiment.

A retention means 1 illustrated in FIG. 1 comprises a base 2, a dorsal support element 3, and retention device(s) or member(s) for a boot on the base 2. In a known manner, the retention members of the boot are represented here in the form of straps 4, 5 that are adjustable in length, and affixed to the base 2 by affixing elements such as pivot members, such as rivets.

FIG. 1 shows two pivots 6, 7 on one side of base 2, the two other pivots being located on the other side of base 2.

The boot, which has not been represented for reasons of simplification and ease of understanding, is retained by the straps 4, 5 along an upper longitudinally extending surface 8 of base 2. The lateral edges 9, 10 of base 2 retain the boot in a substantially transverse direction of device 1, the lateral edges 9, 10 receiving the affixing elements between the straps 4, 5 and base 2.

The transverse direction of device 1 should be understood as being a direction that is substantially perpendicular to the longitudinal plane of the boot that is in place on the base 2. As a result, the transverse direction of device 1 is also substantially perpendicular to the edges 9, 10 of base 2.

A raised portion 11 of the heel support extends base 2 upwardly at the rear of the device 1 by forming an arc between the lateral edges 9, 10 of base 2.

Journal elements, obtained for example, in the form of rivets, connect base 2 and the dorsal support element 3.

A pivot 12, shown in FIG. 1, and another pivot, not shown in FIG. 1, allow the journal of base 2 with respect to the dorsal support element 3, in a known manner. Each pivot is oriented along an axis that is substantially parallel to the transverse direction of device 1.

Consequently, the dorsal support element 3 can pivot towards the front of device 1 in such a way that a top portion 13 of the dorsal support element 3 comes closer to the straps 4, 5 and the upper face 8 of base 2. This characteristic allows the user, for example, to reduce the volume of device 1 for storage purposes.

Inversely, a rearward journal movement, i.e., in such a direction that the top part 13 of the dorsal support element 3 goes further away from straps 4, 5 and the upper face 8 of base 2, is possible up to a limit defined by the contact between the bottom part 14 of the dorsal support element 3 and the raised portion of the heel support 11. This structure allows the user to take support with the rear of the lower part of the leg against the dorsal support element 3. The user can also freely bend his/her legs towards the front.

Device 1 also allows the user to incline the leg along the sides, in lateral bending motions, or in complex bending involving both forward and lateral motions. In order to do this, an intermediate part 15 is located between the top part 13 and the bottom part 14 of the dorsal support element 3.

Figure 2:
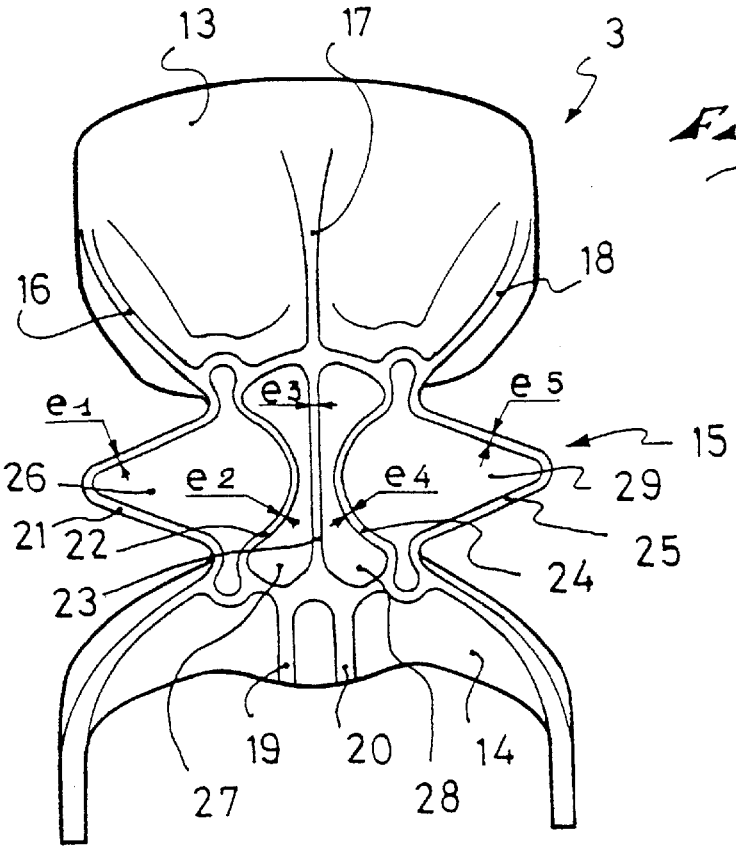
FIG. 2 is a rear view of the dorsal support element of the device of FIG. 1 in an upright position.
Figure 3:
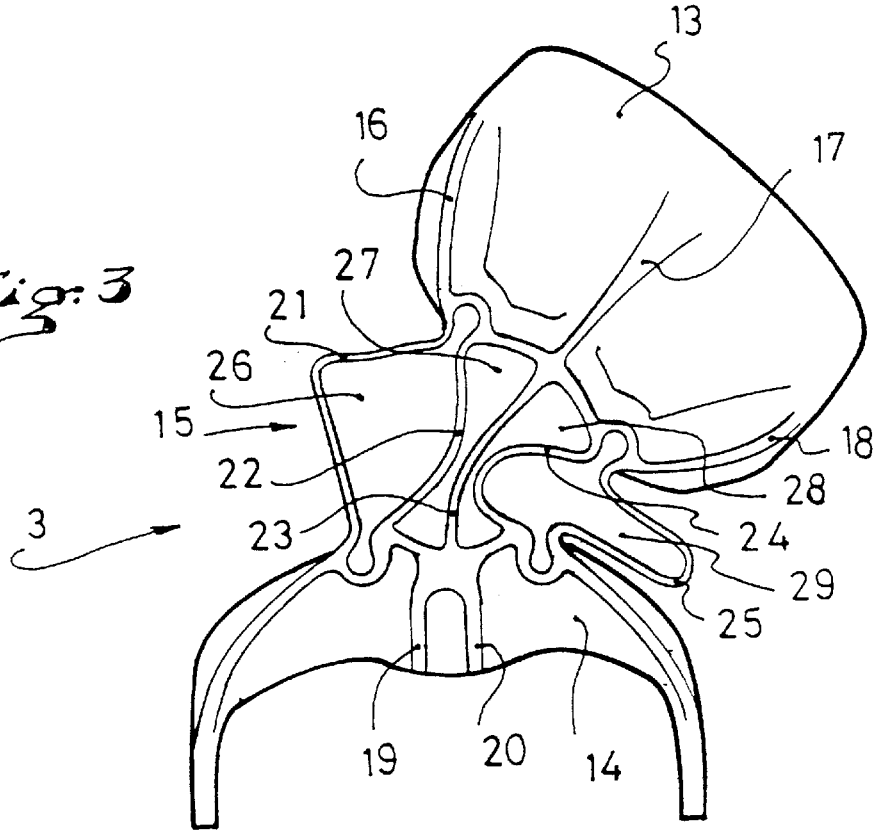
FIG. 3 shows an example of the lateral inclination of the dorsal support element.

FIGS. 1 through 3 correspond to a first embodiment of device 1.

As is apparent from each of FIGS. 1 through 3, the dorsal support element 3 is represented in the form of an integral element. The top 13, intermediate 15 and bottom 14 parts are made all in one piece and obtained for example, by the injection of a plastic material, whether reinforced or otherwise. The top part 13 is in the form of a shell that is relatively rigid in all directions, the reinforcements 16, 17, 18 specifically allowing the lower part of the leg to take support without bending the top part 13.

In the same way, the bottom part 14, which has a shape that complements the shape of the heel support portion 11, comprises reinforcements 19, 20 that are used to stiffen the bottom part 14. As shown in the drawings, at least a part of the intermediate part is positioned below the top part 13 and above the bottom part 14.

The intermediate part 15 is constituted by an assembly of ribs 21, 22, 23, 24, 25, at least one of which is generally vertically elongated, that among themselves, connect the top part 13 and bottom part 14. Each of the ribs 21, 22, 23, 24, 25 has a measured width along the longitudinal direction of device 1 when the dorsal support element 3 is in contact with the heel support portion 11. A width l is shown in FIG. 1 for the rib 21.

FIG. 2 is a rear view of the dorsal support element 3 alone, in which the top part 13, bottom part 14 and intermediate part 15, as well as the ribs 21, 22, 23, 24, 25 are represented. The respective thicknesses of the ribs 21, 22, 23, 24, 25 are represented by the references e1, e2, e3, e4 and e5

In FIG. 2, the dorsal support element 3 is in a position of equilibrium that is obtained in the absence of any transverse bias by the lower part of the user's leg. The ribs 21, 22, 23, 24, 25 demarcate spaces 26, 27, 28, 29 which are open cavities crossing the intermediate part 15 in the direction of the width of the ribs 21, 22, 23, 24, 25. The spaces 26 and 29 are symmetrical with respect to the central rib 23, as well as the spaces 27 and 28.

During any bias of the dorsal support element 3 by the lower part of the leg in a transverse direction in the area of the top part 13, the intermediate part 15 is able to become deformed, as has been shown in FIG. 3, so as to accompany the motion of the lower part of the leg.

In this case, the central rib 23 bends in the direction of inclination of the lower part of the leg, and the other ribs 21, 22, 24, 25 are deformed such that the top part 13 can follow the motion of the lower part of the leg.

In the example represented in FIG. 3, the ribs 21 and 22 are stretched, whereas the ribs 24 and 25 are compressed. The deformations of the ribs 21, 22, 23, 24, 25 are possible because the spaces 26, 27, 28, 29 provide the ribs 21, 22, 23, 24, 25 with sufficient space to become deformed.

The thicknesses e1, e2, e3, e4 and e5 of the ribs 21, 22, 23, 24, 25 are sufficiently reduced so as to allow reversible deformations without tearing the material, and the widths of the ribs 21, 22, 23, 24, 25 are big enough so as to avoid or substantially limit a deformation of the intermediate part 15 in a substantially parallel direction with respect to the longitudinal plane of the boot.

As a result, the dorsal support element 3 is deformed in proportion to the transverse motions of the lower part of the leg, so as to faithfully follow the motions of the latter. As a matter of fact, the deformations of ribs 21, 22, 23, 24, 25 do not define a precise rotational axis, but rather an infinity of axes to accommodate the complexity of movements of the user's ankle.

The transverse deformations of the intermediate part 15 of the dorsal support element 3 allows the top part 13 to follow the lower part of the leg by exerting, on the latter, a return force towards the position of equilibrium of FIG. 2. Indeed, the deformations of ribs 21, 22, 23, 24, 25 are elastic deformations that become translated, from a technical view point, by an accumulation of energy.

The greater the inclination of the top part 13, the greater is the return force of the top part 13 towards the position of equilibrium.

Figure 4:
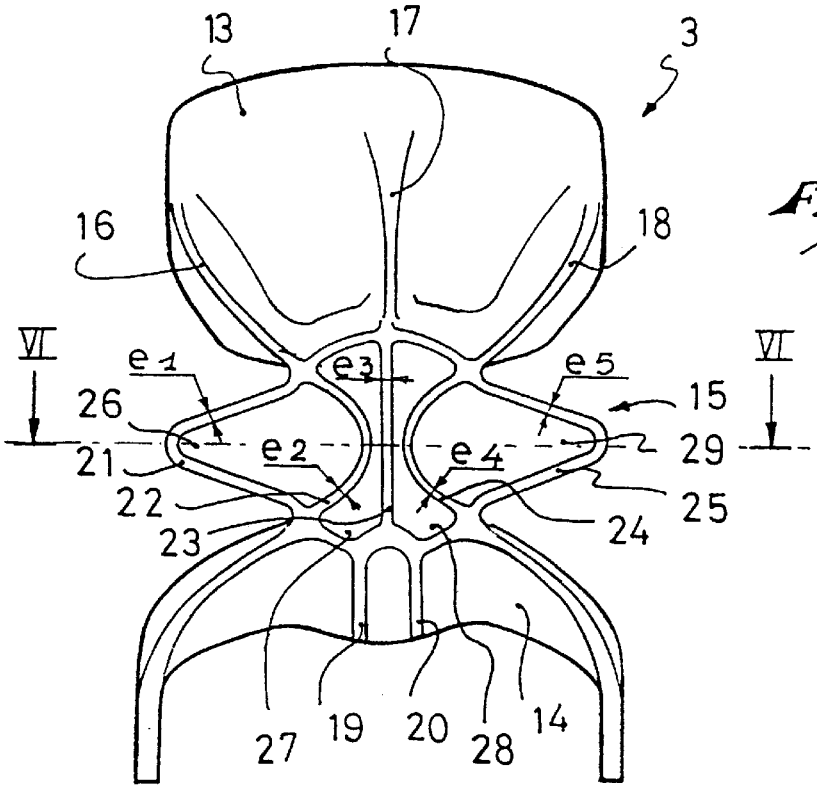
FIG. 4 is similar to FIG. 2 but corresponds to a second embodiment.
Figure 5:
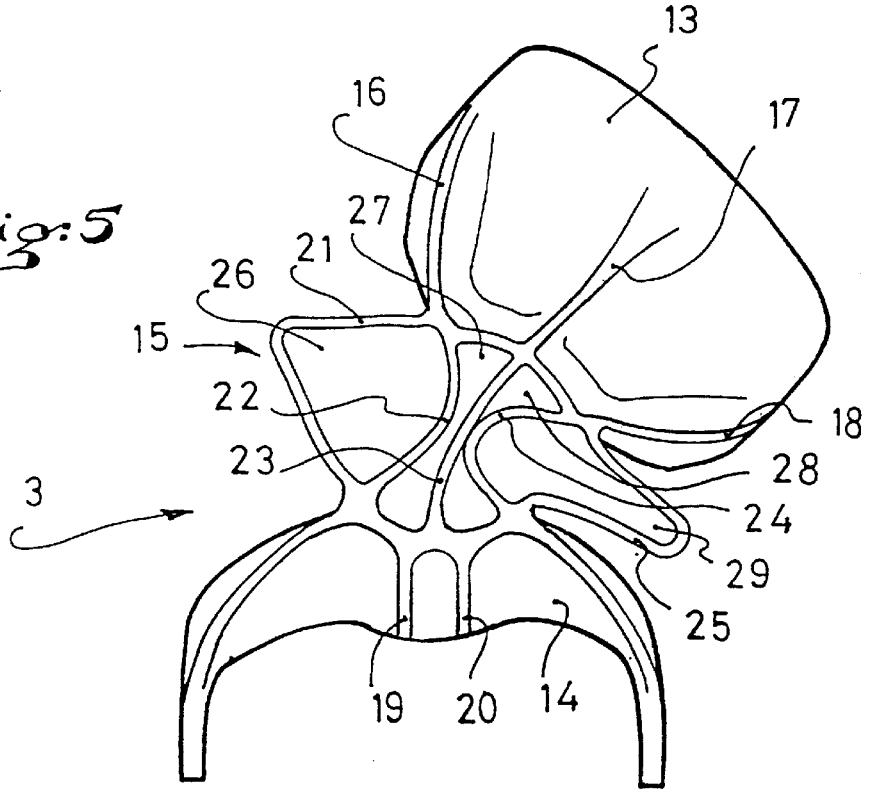
FIG. 5 shows an example of the lateral inclination of the dorsal support element with respect to the second embodiment.

Another embodiment of the device is represented in FIGS. 4 and 5.

The only difference with respect to the previous embodiment is that the shapes of the ribs and reinforcements are different from the first embodiment. Thus, detailed explanations have not been provided and the same references have been used.

The materials used for obtaining the dorsal support element 3 are preferably polybutyleneterephtalates, polyurethanes or polyamides, injected at temperatures comprised between approximately 150° C. and 300° C., and at pressures comprised between 10 and 200 bars.

The other elements of device 1 are preferably made of plastic materials, reinforced or otherwise, metals, fabrics, etc. The techniques used are traditional techniques that are known to persons of the art.

The invention is not limited to the specific embodiments described, and comprises all technical equivalents that could enter the scope of the following claims.

In particular, one could provide a wide variety of other shapes to the ribs of the intermediate part 15.

One could also provide a different number of ribs, greater or less than five.

Figure 6:
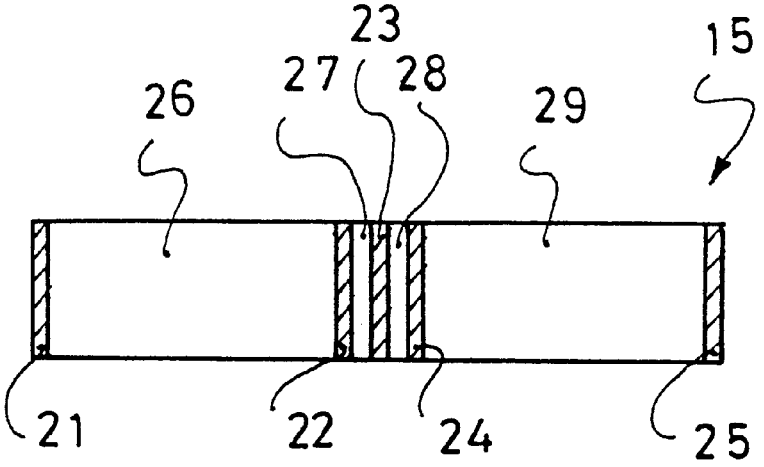
FIG. 6 is a cross section according to VI—VI of FIG. 4.
Figure 7:
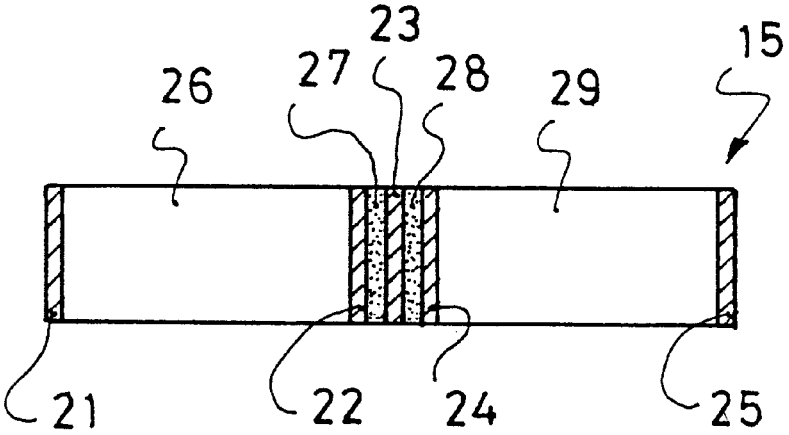
FIG. 7 is similar to FIG. 6, but corresponds to a further embodiment.
Figure 8:
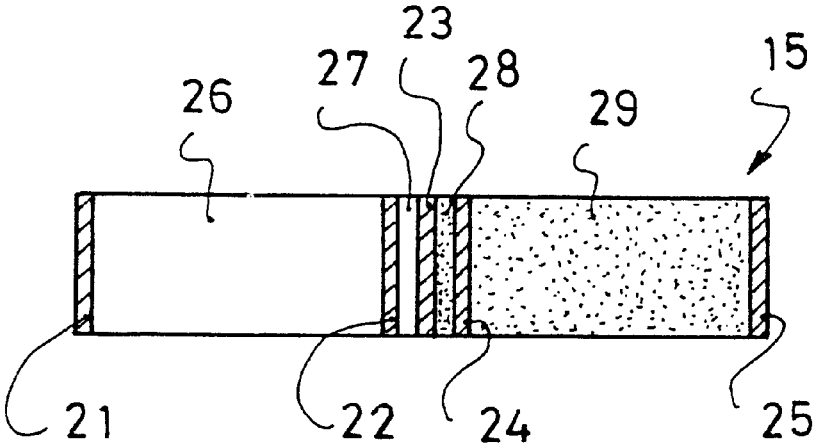
FIG. 8 is similar to FIG. 6, but corresponds to yet a further embodiment.

One can also modify the transverse deformation ability of the intermediate part 15, shown in cross section in FIG. 6, by choosing an asymmetrical structure, or by partially or totally filling one or several of the spaces with a deformable material such as foam or rubber. For example, as shown in FIG. 7, spaces 27, 28 are filled with foam or rubber. In the case shown in FIG. 8, spaces 28, 29 are filled with foam or rubber, while spaces 26, 27 are open.

One could also ensure that the ribs are not strictly parallel, either in order to make unmolding easier during manufacture, or to improve the removal of snow when the device is in use.

One could also provide for the use of different materials in order to make the various component parts of the dorsal support element 3. In this case, the ribs would be connected to the top part 13 and bottom part 14 by any means, such as adhesion, nesting or other.

What is claimed is:

1. A retention device for retaining a boot on a snowboard, said retention device comprising:

a base having a longitudinally extending lower surface adapted to receive a sole of the boot, said base including a heel support extending upwardly from said lower surface, said heel support including a raised portion;

a dorsal support element against which an upper of the boot is adapted to be supported, said dorsal support element comprising a top part, a bottom part, and an intermediate part, said bottom part being connected to said base, at least a portion of said intermediate part being positioned above an uppermost portion of said bottom part and below a lowermost portion of said top part, said top part and said bottom part being rigid, relative to said intermediate part, and said intermediate part being deformable, said intermediate part comprising at least one upwardly elongated rib allowing inclination of said top part with respect to said bottom part along at least one direction transverse of said device.

2. A retention device as defined by claim 1, wherein each of said at least one rib has a generally longitudinally extending width and a generally transversely extending thickness, a ratio of said width to said thickness being greater than or equal to five.

3. A retention device as defined by claim 1, wherein said top part, said bottom part and said intermediate part of said dorsal support element are made all in one piece.

4. A retention device as defined by claim 3, wherein said dorsal support element is made from a plastic material.

5. A retention device as defined by claim 3, wherein said intermediate deformable part of said dorsal support element includes at least one space at least partially filled by a material different from a component material of said dorsal support element.

6. A retention device as defined by claim 1, further comprising a journal connection between said dorsal support element and said base, said journal connection extending along a substantially transverse axis of said device.

7. A retention device as defined by claim 6, wherein said raised portion of said heel support comprises an abutment surface against which said dorsal support element is adapted to abut to limit any displacement of said dorsal support element around the transverse axis in a front to rear direction.

8. A retention device as defined by claim 1, wherein said upwardly extending rib has a longitudinally extending width and a transversely extending thickness, said width being greater than said thickness.

9. A retention device as defined by claim 1, wherein said at least one upwardly elongated rib comprises a plurality of upwardly elongated ribs.

10. A retention device as defined by claim 9, wherein said plurality of upwardly elongated ribs comprises at least five ribs, spaces being positioned between respective ones of said five ribs.

11. A retention device as defined by claim 10, wherein each of said ribs has a generally longitudinally extending width and a generally transversely extending thickness, a ratio of said width to said thickness being greater than or equal to five.

12. A retention device as defined by claim 10, wherein two juxtaposed ribs of said at least five ribs have opposing faces forming an angle comprised between zero and eight degrees.

13. A retention device for retaining a boot on a snowboard, said retention device comprising:

a base having a longitudinally extending lower surface adapted to receive a sole of the boot, said base including a heel support extending upwardly from said lower surface, said heel support including a raised portion;

a dorsal support element against which an upper of the boot is adapted to be supported, said dorsal support element comprising a top part, a bottom part, and an intermediate part, said bottom part being connected to said base, said intermediate part being positioned between said top part and said bottom part, said top part and said bottom part being rigid, relative to said intermediate part, and said intermediate part being elastically deformable and comprising at least five generally upwardly elongated members, each said member comprising a rib, as viewed longitudinally, spaces being positioned between respective ones of said five ribs, said intermediate part allowing inclination of said top part with respect to said bottom part along at least one direction transverse of said device.

14. A retention device as defined by claim 13, wherein each of said ribs has a generally longitudinally extending width and a generally transversely extending thickness, a ratio of said width to said thickness being greater than or equal to five.

15. A retention device as defined by claim 13, wherein two juxtaposed ribs of said at least five ribs have opposing faces forming an angle comprised between zero and eight degrees.

16. A retention device as defined by claim 13, further comprising a journal connection between said dorsal support element and said base, said journal connection extending along a substantially transverse axis of said device.

17. A retention device as defined by claim 16, wherein said raised portion of said heel support comprises an abutment surface against which said dorsal support element is adapted to abut to limit any displacement of said dorsal support element around the transverse axis in a front to rear direction.

18. A retention device for retaining a boot on a snowboard, said retention device comprising:

a base having a longitudinally extending lower surface adapted to receive a sole of the boot, said base including a heel support extending upwardly from said lower surface, said heel support including a raised portion;

a dorsal support element against which an upper of the boot is adapted to be supported, said dorsal support element comprising a top part, a bottom part, and an intermediate part, said bottom part being connected to said base, said intermediate part being positioned between said top part and said bottom part, said top part and said bottom part being rigid, relative to said intermediate part, and said intermediate part being elastically deformable and comprising at least one generally upwardly elongated member, said member comprising at least one rib, as viewed longitudinally, said intermediate part allowing inclination of said top part with respect to said bottom part along at least one direction transverse of said device, each of said at least one rib having a generally longitudinally extending width and a generally transversely extending thickness, a ratio of said width to said thickness being greater than or equal to five.

19. A retention device as defined by claim 18, further comprising a journal connection between said dorsal support element and said base, said journal connection extending along a substantially transverse axis of said device.

20. A retention device as defined by claim 19, wherein said raised portion of said heel support comprises an abutment surface against which said dorsal support element is adapted to abut to limit any displacement of said dorsal support element along the transverse axis in a front to rear direction.

21. A retention device for retaining a boot on a snowboard, said retention device comprising:

a base having a longitudinally extending lower surface adapted to receive a sole of the boot, said base including a heel support extending upwardly from said lower surface, said heel support including a raised portion;

a dorsal support element against which an upper of the boot is adapted to be supported, said dorsal support element comprising a top part, a bottom part, and an intermediate part, said bottom part being connected to said base, said intermediate part being positioned between said top part and said bottom part, said top part and said bottom part being rigid, relative to said intermediate part, and said intermediate part being elastically deformable and comprising at least one generally upwardly elongated member, said member comprising a rib, as viewed longitudinally, said intermediate part allowing inclination of said top part with respect to said bottom part along at least one direction transverse of said device;

said top part, said bottom part and said intermediate part of said dorsal support element being made all in one piece.

22. A retention device as defined by claim 21, wherein said dorsal support element is made from a plastic material.

23. A retention device as defined by claim 21, wherein said intermediate deformable part of said dorsal support element includes at least one space at least partially filled by a material different from a component material of said dorsal support element.

24. A retention device as defined by claim 21, further comprising a journal connection between said dorsal support element and said base, said journal connection extending along a substantially transverse axis of said device.

25. A retention device as defined by claim 24, wherein said raised portion of said heel support comprises an abutment surface against which said dorsal support element is adapted to abut to limit any displacement of said dorsal support element along the transverse axis in a front to rear direction.

26. A retention device for retaining a boot on a snowboard, said retention device comprising:

a base having a longitudinally extending lower surface adapted to receive a sole of the boot, said base including a heel support extending upwardly from said lower surface, said heel support including a raised portion;

a dorsal support element against which an upper of the boot is adapted to be supported, said dorsal support element comprising a top part, a bottom part, and an intermediate part, said bottom part being connected to said base, said intermediate part being positioned between said top part and said bottom part, said top part and said bottom part being rigid, relative to said intermediate part, and said intermediate part being deformable, said top part, said bottom part and said intermediate part of said dorsal support element being made all in one piece, said intermediate part allowing inclination of said top part with respect to said bottom part along at least one direction transverse of said device.

27. A retention device as defined by claim 26, wherein said intermediate deformable part comprises at least one rib.

28. A retention device as defined by claim 27, wherein each of said at least one rib has a generally longitudinally extending width and a generally transversely extending thickness, a ratio of said width to said thickness being greater than or equal to five.

29. A retention device as defined by claim 26, wherein said intermediate deformable part comprises at least five ribs, spaces being positioned between respective ones of said five ribs.

30. A retention device as defined by claim 29, wherein each of said ribs has a generally longitudinally extending width and a generally transversely extending thickness, a ratio of said width to said thickness being greater than or equal to five.

31. A retention device as defined by claim 29, wherein two juxtaposed ribs of said at least five ribs have opposing faces forming an angle comprised between zero and eight degrees.

32. A retention device as defined by claim 26, wherein said dorsal support element is made from a plastic material.

33. A retention device as defined by claim 26, wherein said intermediate deformable part of said dorsal support element includes at least one space at least partially filled by a material different from a component material of said dorsal support element.

34. A retention device as defined by claim 26, further comprising a journal connection between said dorsal support element and said base, said journal connection extending along a substantially transverse axis of said device.

35. A retention device as defined by claim 34, wherein said raised portion of said heel support comprises an abutment surface against which said dorsal support element is adapted to abut to limit any displacement of said dorsal support element around the transverse axis in a front to rear direction.

36. A retention device for retaining a boot on a snowboard, said retention device comprising:

a base having a longitudinally extending lower surface adapted to receive a sole of the boot, said base including a heel support extending upwardly from said lower surface, said heel support including a raised portion;

a dorsal support element against which an upper of the boot is adapted to be supported, said dorsal support element comprising a top part, a bottom part, and an intermediate part, said bottom part being connected to said base, at least a portion of said intermediate part being positioned above an uppermost portion of said bottom part and below a lowermost portion of said top part, said top part and said bottom part being relatively rigid and said intermediate part being deformable, said intermediate part allowing inclination of said top part with respect to said bottom part along at least one direction transverse of said device, and said top part, said bottom part and said intermediate part of said dorsal support element are made all in one piece.

37. A retention device as defined by claim 36, wherein said dorsal support element is made from a plastic material.

38. A retention device as defined by claim 36, wherein said intermediate deformable part of said dorsal support element includes at least one space at least partially filled by a material different from a component material of said dorsal support element.

* * * * *